US010186125B2

(12) United States Patent
Turgeon

(10) Patent No.: US 10,186,125 B2
(45) Date of Patent: Jan. 22, 2019

(54) SYSTEMS AND METHODS FOR TRACKING ITEMS REMOVED WITHOUT AUTHORIZATION FROM SECURED LOCATIONS

(71) Applicant: Charles T. Turgeon, Lighthouse Point, FL (US)

(72) Inventor: Charles T. Turgeon, Lighthouse Point, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 14/974,855

(22) Filed: Dec. 18, 2015

(65) Prior Publication Data

US 2017/0178477 A1 Jun. 22, 2017

(51) Int. Cl.
*G08B 13/14* (2006.01)
*G08B 13/24* (2006.01)

(52) U.S. Cl.
CPC ..... *G08B 13/2405* (2013.01); *G08B 13/2417* (2013.01); *G08B 13/2451* (2013.01); *G08B 13/2462* (2013.01)

(58) Field of Classification Search
CPC ..... G08B 13/2405; G08B 13/2451; G08B 13/2417; G08B 13/2462
USPC ..... 340/572.1–572.9, 10.1–10.6
See application file for complete search history.

(56) References Cited

U.S. PATENT DOCUMENTS 8,866,596 B1 * 10/2014 Diorio ..... G06K 7/10366 340/10.51
9,396,425 B1 * 7/2016 Schattmaier ..... G08B 6/00
2007/0159338 A1 * 7/2007 Beber ..... G06K 19/0704 340/572.8
2008/0061967 A1 * 3/2008 Corrado ..... G06K 7/10079 340/539.26
2008/0198001 A1 * 8/2008 Sarma ..... G06Q 10/087 340/539.1
2009/0079580 A1 * 3/2009 Kaplan ..... G08B 21/0227 340/686.6
2009/0231138 A1 * 9/2009 Lai ..... G06K 19/0707 340/572.4
2009/0322537 A1 * 12/2009 Tapp ..... G08B 13/19697 340/572.4
2010/0066503 A1 * 3/2010 Rhie ..... G01S 1/68 340/10.1
2010/0134257 A1 * 6/2010 Puleston ..... G06K 7/0008 340/10.4
2010/0201520 A1 * 8/2010 Stern ..... G01S 13/75 340/572.1

(Continued)

*Primary Examiner* — Kerri L McNally
*Assistant Examiner* — Thang D Tran
(74) *Attorney, Agent, or Firm* — Fox Rothschild LLP; Robert J. Sacco; Carol E. Thorstad-Forsyth

(57) ABSTRACT

Tracking items of items in a facility involves using an RFID portal system to determine when an EAS tag containing an RFID element has exited from a secured area within the facility. The EAS tag is triggered to initiate a wireless beacon signal upon exiting. Thereafter, control logic associated with the EAS tag is used to cause the wireless beacon signal to be communicated at predetermined intervals. The wireless beacon signal includes unique identifier information concerning the EAS tag. When the beacon signal is received at one or more short range communication (SRC) devices outside the secured area, its location is determined.

25 Claims, 6 Drawing Sheets

(56) References Cited

U.S. PATENT DOCUMENTS

2010/0277322 A1* 11/2010 Eckert ..... G08B 13/2434 340/572.3
2011/0072132 A1* 3/2011 Shafer ..... G06Q 10/087 709/224
2011/0074582 A1* 3/2011 Alexis ..... G08B 13/149 340/572.1
2011/0080267 A1* 4/2011 Clare ..... G01S 13/82 340/10.4
2012/0044074 A1* 2/2012 Mulla ..... G06Q 10/08 340/572.1
2012/0161967 A1* 6/2012 Stern ..... G06K 7/10366 340/572.1
2013/0002879 A1* 1/2013 Weber ..... G08B 13/2462 348/159
2013/0169413 A1* 7/2013 Schuessler ..... G08B 13/2417 340/10.1
2014/0062790 A1* 3/2014 Letz ..... H04W 4/21 342/386
2015/0054620 A1* 2/2015 Graube ..... G06K 7/10009 340/10.1
2015/0169915 A1* 6/2015 Petre ..... G06K 19/0702 340/10.6
2015/0194030 A1* 7/2015 Davidson ..... G06K 7/10356 340/572.7
2015/0235161 A1* 8/2015 Azar ..... G06Q 10/063114 705/7.15
2016/0055360 A1* 2/2016 Haugarth ..... G06Q 30/0201 340/10.1
2016/0057508 A1* 2/2016 Borcherdt ..... H04N 21/2353 715/719
2016/0140821 A1* 5/2016 Moeini ..... G08B 13/2462 340/572.1
2016/0142873 A1* 5/2016 Trivedi ..... H04W 4/021 455/456.1
2016/0171486 A1* 6/2016 Wagner ..... G06Q 20/12 705/39
2016/0180674 A1* 6/2016 Hoehn ..... G08B 13/2402 340/572.1
2016/0196485 A1* 7/2016 Patterson ..... G06K 19/0723 340/572.1
2016/0217361 A1* 7/2016 Schattmaier ..... G08B 6/00
2016/0260053 A1* 9/2016 Barron ..... G01S 19/01
2016/0266227 A1* 9/2016 Newman ..... H04W 4/80

* cited by examiner

SYSTEMS AND METHODS FOR TRACKING ITEMS REMOVED WITHOUT AUTHORIZATION FROM SECURED LOCATIONS

BACKGROUND OF THE INVENTION

Statement of the Technical Field

The inventive arrangements relate to systems and methods for the prevention of theft, and more particularly to tracking items removed without authorization from secured or controlled locations.

Description Of The Related Art

High value merchandise such as hand bags, electronics, apparel, shoes, and other high theft items are subject to smash and grab or organized retail theft. Today, these items are protected with traditional Electronic Article Surveillance (EAS) solutions. These EAS solutions include active alarming EAS tags in various formats such as lanyards, pin, and cable options that can trigger an alert from the EAS system. These EAS tags are also available in formats which self-alarm if tampered with or removed from the secured area.

One problem with the use of EAS tags is that they are largely ineffective once they are removed from the secured area or exit of a retail store. The EAS tag triggers the alarm, but the transport of the high value merchandise out of the retail store and/or associated shopping center does not. The person engaging in the unauthorized removal of such item disappears into a crowd of shoppers and/or departs rapidly from the area of the retail store.

A portal is a system which is used for tracking items passing through doorways, hallways or corridors. Many different types of portal systems are possible. These systems can include traffic flow sensors arranged as stand-alone devices or integrated into other types of monitoring systems. For example a traffic flow sensor can be integrated into an EAS pedestal, or may involve an imaging system and suitable video analytics. In such systems, different types of sensing devices can be interconnected and/or used together to provide the directionality function. Conventional EAS portals identify the direction of EAS tags crossing a portal transition defined by a choke point through which items must pass when they move from one defined area to a second defined area. An EAS portal comprising RFID technology consists at minimum of two separate antennas and a RFID reader. The tag directionality is easily determined by the order of the reads. A tag read by a first antenna and then by the second antenna is likely moving from the first to second antenna. RFID portals can also use beam steerable antennas to detect the presence of RFID tags in different locations as they move through a portal zone. In a conventional configuration, the minimum setup is one RFID reader and one beam steerable antenna. In such scenarios, the physical separation between multiple antennas is no longer needed to determine tag directionality.

A number of organizations have set standards for RFID tags. One type of RFID tag for which a standard has been established is known as an EPCglobal UHF Class 1 Generation 2 (hereinafter "EPC Gen2") type tags. These tags have certain well known characteristics.

Bluetooth Low Energy (BLE) technology is a wireless personal area network technology designed and marketed by the Bluetooth Special Interest Group. BLE is designed to facilitate reduced power consumption and cost as compared to conventional Bluetooth communications devices, but has a similar communication range. BLE devices can be arranged to form networks which are known as piconets.

The network topology that results by the connection of piconets is called a scatternet. There exists a growing body of research involving methods for the formation of scatternets and routing algorithms for multi-hop Bluetooth networks.

The low cost of BLE enabled devices has resulted in an increasing interest in their deployment in a wide variety of ubiquitous applications. For example, BLE technology has been incorporated into smart light bulbs offered for sale by various manufacturers. Indoor proximity systems are also well known in the art. One conventional indoor proximity system is known as iBeacon®. iBeacon® employs Bluetooth communication technology to connect to mobile communication devices (e.g., cellular phones). iBeacons broadcast or advertise self-contained packets of data at set intervals (e.g., 100 ms intervals). These packets are intended for reception by devices such as smartphones or tablets. When received, the packet of data can be used by a smartphone application to trigger events on the device. Standard BLE has a broadcast range of up to 100 meters. Software applications which are installed on a consumer's smartphone can listen for iBeacons located around the retail store. When an iBeacon is detected, it communicates certain relevant data concerning the iBeacon to its server.

SUMMARY OF THE INVENTION

Embodiments of the invention concern a method for tracking items in a facility. The method involves using an RFID portal system to determine when an EAS tag containing an RFID element has exited from a secured area within the facility. In response to determining that the EAS tag has exited from the secured area, the EAS tag is wirelessly triggered to initiate a wireless beacon signal compliant with a short range wireless communication standard. Thereafter, control logic associated with the EAS tag is used to cause the wireless beacon signal to be communicated at predetermined intervals. The wireless beacon signal includes a unique identifier information concerning the EAS tag.

The wireless beacon signal is received at one or more of a plurality of short range communication (SRC) devices which are distributed at locations around the facility external of the secured area. Responsive to receiving the wireless beacon signal, a data network is used to communicate at least one notification from at least one of the SRC devices to a security server to indicate receipt of the wireless beacon signal. At the security server a location of the EAS tag at the facility is identified. This location will be external of the secured area, based on a location of one or more of the SRC devices which originated the at least one notification.

The invention also concerns a tracking system for a facility. The system includes at least one security server communicatively coupled to at least one data network. A plurality of the short range communication (SRC) devices are distributed at various locations associated at the facility and operate in accordance with a short range wireless communication standard (SRWCS). Each SRC device includes a receiver capable of receiving a wireless beacon signal from one or more of a plurality of SRC enabled EAS tags when in proximity thereof. The wireless beacon signals are compliant with the SRWCS. Each SRC device includes at least one data network device to facilitate communication with other devices, including the at least one security server, using the at least one data network.

A data store is provided that is accessible to the security server and contains information specifying a location of each of the plurality of SRC devices. The security server is arranged to receive EAS notifications over the data network from each of a plurality of EAS servers which are used respectively to control security functions of a plurality of defined security areas within the facility.

Each of the SRC devices is responsive to receipt of the wireless beacon signal from the SRC enabled EAS tags to cause a notification to be sent to the security server. The security server is responsive to the notification to determine an approximate location of the EAS tag at the facility based on the notification and by using the location information in the data store.

The invention also concerns an electronic article surveillance (EAS) system. The EAS system includes an EAS portal and an EAS tag having a tag housing. An RFID element is disposed in the tag housing. The RFID element is responsive to an RFID interrogation field applied at the EAS portal to generate an encoded RF signal which contains a first unique identifier information assigned to the EAS tag. A short range communication (SRC) beacon system is also disposed in the tag housing. The SRC beacon system continuously generates an SRC radio beacon transmission at predetermined intervals in response to a beacon enable signal.

The EAS portal includes at least one transmitter which is arranged to generate at least one wireless transmission which initiates the beacon enable signal in response to an unauthorized transition of the EAS tag across a boundary associated with the EAS portal. The SRC radio beacon transmission includes a second unique identifier of the EAS tag, which can be the same or different as compared to the first unique identifier.

The invention also concerns an electronic article surveillance (EAS) tag. The EAS tag is comprised of a tag housing. A passive RFID element is disposed in the tag housing. The passive RFID element is responsive to an RFID interrogation field applied at the EAS portal to generate an encoded RF signal which contains a first unique identifier information assigned to the EAS tag.

A short range communication (SRC) beacon system is also disposed in the tag housing. Once initiated, the SRC beacon system is configured to continuously generate at predetermined intervals a radio beacon transmission compliant with a short range wireless communication standard (e.g. a Bluetooth data communication standard). The continuously generated beacon transmission is initiated in response to a beacon enable signal. At least one wireless transmission is used to initiate the beacon enable signal. The radio beacon transmission described herein includes a second unique identifier of the EAS tag, which can be the same or different as the first unique identifier.

BRIEF DESCRIPTION OF THE DRAWINGS

Embodiments will be described with reference to the following drawing figures, in which like numerals represent like items throughout the figures, and in which.

Figure 1:
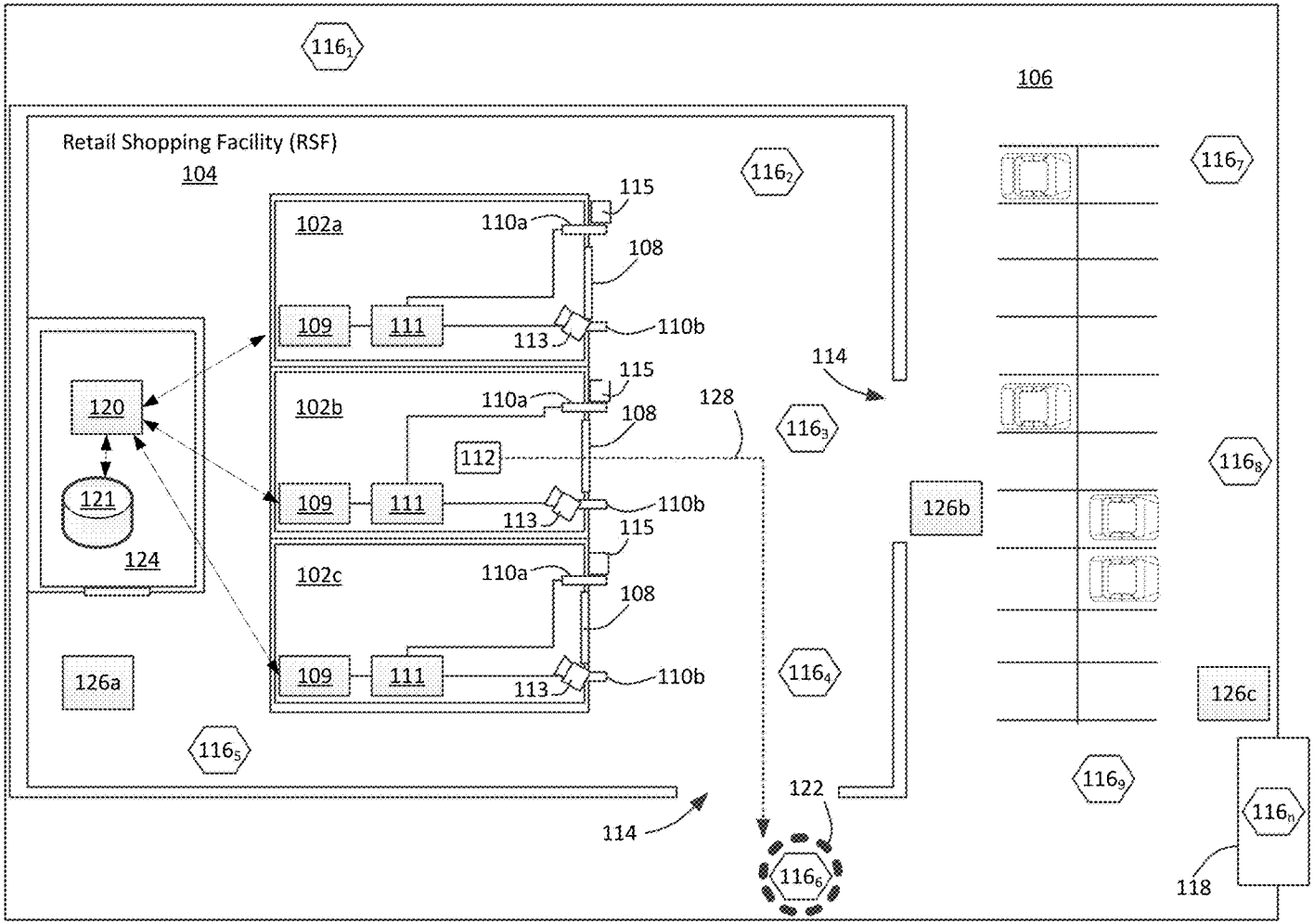
FIG. 1 is a top view of a shopping area that is useful for understanding the inventive arrangements.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

DETAILED DESCRIPTION

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments of the present invention will now be described with respect to FIGS. 1-7. The present invention generally relates to novel systems and methods for prevention of theft by using beacon type proximity systems to track locations of items.

As shown in FIG. 1, a shopping area 100 can include at a Retail Shopping Facility ("RSF") 104. In some scenarios, the RSF 104 may be arranged to include a parking lot 106 or other exterior facilities. The RSF 104 can include two or more retail stores 102*a*, 102*b*, 102*c* which offer merchandise for sale. One or more of the retail stores can comprise a secured retail environment (SRE) which utilizes a suitable Electronic Article Surveillance (EAS) technology to trigger an alarm when merchandise is carried out of the retail store. Conventional EAS systems can be effective for alerting store personnel (and RSF security personnel) in the event of such an occurrence, but do not provide a means for tracking the movement of such merchandise through the RSF 104 and/or parking area 106 after it leaves the retail store. Accordingly, RSF security personnel can find it difficult to prevent the merchandise from being subsequently carried out of the RSF 104. This is a major drawback to conventional EAS systems, particularly in the case of high value merchandise.

In order to overcome this limitation of conventional EAS systems, an EAS tag 112 is provided which uses wireless communication technology to facilitate tracking of items after they have been removed without authorization from a secured area, such as a retail store 102*a*, 102*b*, 102*c*. The EAS tag 112 can include a tag housing 201 which encloses one or more tag components described below. The tag housing can include any of several well-known attaching structures 203 (such as pins, cables, locks) which facilitate securely attaching the tag housing to merchandise or other items which are intended to not leave a secured environment (e.g., a retail store) without proper authorization.

The wireless communication technology used by the EAS tag referenced herein can include, but is not limited to, Short Range Communication ("SRC") technology and RFID technology. The SRC technology includes, but is not limited to, Bluetooth technology, and more particularly can include Bluetooth Low Energy (BLE) technology. Bluetooth is a standard data communications protocol designed for low-power consumption, with a short range (e.g., less than 100 meters) based on low-cost transceiver microchips. BLE extends the use of Bluetooth wireless technology so as to consume much less power as compared to radios which conform to a basic Bluetooth standard. In fact, BLE practically facilitates the use of Bluetooth wireless technology in devices powered by small, coin-cell batteries.

As explained below in further detail, the EAS tag 112 has the ability to use SRC technology to communicate with a plurality of SRC devices $\mathbf{116}_1$, $\mathbf{116}_2$ . . . $\mathbf{116}_n$ which are disposed throughout the RSF 104. The RFID technology referenced herein can conform to a suitable RFID tag standard. For example, a suitable RFID standard is the EPCglobal UHF Class 1 Generation 2 (hereinafter "EPC Gen2") standard.

Figure 2:
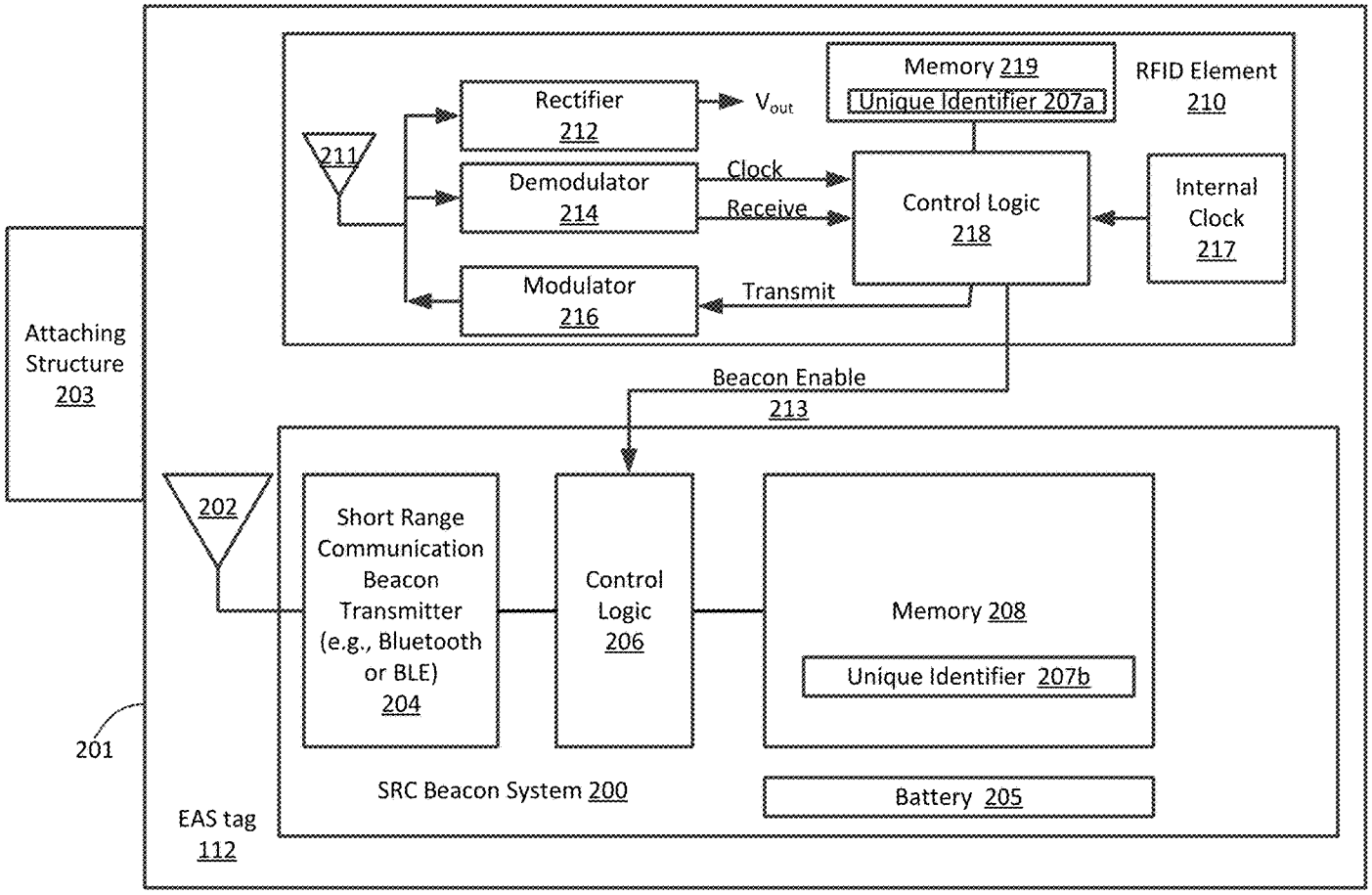
FIG. 2 is a simplified block diagram that is useful for understanding an EAS tag according to the inventive arrangements.

Referring now to FIG. 2, there is provided a schematic illustration of an exemplary architecture for an EAS tag 112 of FIG. 1. EAS tag 112 can include more or less components than that shown in FIG. 2. However, the components shown are sufficient to disclose an illustrative embodiment implementing the present invention. Some or all of the components of the EAS tag 112 can be implemented in hardware, software and/or a combination of hardware and software. The hardware includes, but is not limited to, one or more electronic circuits. The electronic circuit may comprise passive components (e.g., capacitors and resistors) and active components (e.g., processors) arranged and/or programmed to implement the methods disclosed herein.

The hardware architecture of FIG. 2 represents an embodiment of a representative EAS tag 112 configured to facilitate improved tracking of items removed from a secured facility without authorization. In this regard, the EAS tag 112 comprises an SRC beacon system 200 and an RFID element 210. RFID elements are well known in the art and therefore will not be described here in detail. However, an exemplary RFID element architecture is illustrated in FIG. 2 as an aid to understanding the invention. As shown in FIG. 1, the RFID element 210 can include an antenna 211 for receiving RFID interrogation signals from an RFID reader. The antenna is connected to a rectifier 212 for extracting a drive voltage $V_{out}$ from an electromagnetic field which is generated by an RFID reader. This drive voltage can be used to operate the various electronic components comprising the RFID element.

The RFID element includes a demodulator 214 for demodulating RFID interrogation signals and extracting a clock signal generated by an RFID reader. An output of the demodulator is connected to control logic 218 which decodes the RFID interrogation signals and responds to same. The control logic 218 can be at least partially under the control of an internal clock 217. In response to an RFID interrogation Receive signal, the control logic can cause a modulator 216 to generate an RF signal Transmit signal suitable for responding to the RFID interrogation signal. For example, the control logic 218 can access a unique identifier value 207*a* stored in a data store or memory 219, and cause such unique identifier to be broadcast using antenna 211. The RFID element 210 can be a passive RFID element designed to comply with an RFID standard which is now known or is known in the future. An exemplary RFID standard of this kind is the EPC Gen2 standard. Still, the invention is not limited in this regard and RFID elements conforming to different standards can also be used.

The SRC beacon system 200 facilitates an exchange of data with an external device (e.g., an SRC device $\mathbf{116}_1$, $\mathbf{116}_2$ . . . $\mathbf{116}_n$ of FIG. 1) via SRC technology (e.g., Bluetooth technology or BLE technology). The components 204-208 shown in FIG. 2 may be collectively referred to herein as the SRC beacon system 200.

The SRC beacon system 200 comprises an antenna 202 for allowing data to be exchanged with the external device via SRC technology. The antenna 202 is configured to transmit SRC signals generated by an SRC beacon transmitter 204. SRC beacon transmitters are known in the art, and therefore will not be described in detail herein. The SRC transmitter 204 transmits SRC signals which can include unique identifier information 207*b*. The SRC signals provide a means for an SRC device $\mathbf{116}_1$, $\mathbf{116}_2$ . . . $\mathbf{116}_n$ which receives the signals to determine the location of the EAS tag within a given facility (e.g., RSF 104 of FIG. 1).

The control logic 206 accesses memory 208 to retrieve the unique identifier 207*b* for transmission by the transmitter 204. Control logic 206 also determines the timing or period of the SRC signal which is transmitted by the SRC beacon system 200. According to one aspect of the invention, the initiation of SRC beacon transmissions can be triggered in response to a beacon enable signal 213 received from control logic 218 in the RFID element. When the beacon enable signal is received by control logic 206, it initiates beacon transmission. In other embodiments, a transceiver can be used in place of transmitter 204 and the control logic 206 can respond to a received SRC control signal to initiate the beacon transmissions described herein.

The memory 208 is a data store which may comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure. The memory 208 can contain the unique identifier 207*b* information for the EAS tag 112. The unique identifier 207*b* can be the same as the unique identifier 207*b* used by the RFID element. The various active elements of the SRC beacon system 200 can be powered by a battery 205, which may be a small coin cell so as to minimize cost, weight and size of the EAS tag.

Referring once again to FIG. 1, an EAS system in a retail store (e.g. retail store 102*b*) can include an RFID portal system which detects EAS tags 112 which pass through a choke point 108. Only one EAS tag is shown in FIG. 1, but it will be understood that a typical retail store may contain many such EAS tags which are attached to various items or merchandise. The choke point 108 defines a boundary between the interior of the retail store and the remainder of the RSF 104. As such, the choke point can be located at an entryway or hallway which patrons must use for ingress and egress to the interior of the retail store. The RFID portal system can be comprised of an RFID server 109, one or more RFID readers 111, and one or more RFID antennas 110*a*, 110*b*. RFID portal systems are well known in the art and therefore will not be described in detail. However, it should be understood that a RFID portal system can determine a unique identifier 207*a* of an EAS tag 112 which is moving across a boundary defined by a choke point. This is accomplished by conventional means using an RFID interrogation signal to cause the EAS tag to broadcast its unique identifier 207*a*. The RFID portal system can also detect a direction of movement of such tag. Accordingly, the RFID portal system can determine when a particular EAS tag is exiting from a retail store. In such a scenario, the RFID portal system can make a determination as to whether the departure of the EAS tag from the retail store has been authorized. For example, such a determination can be made by comparing the tag unique identification 207*a* information to information contained in a point-of-sale (POS) database.

When an RFID portal associated with a retail store 102*a*, 102*b*, 102*c* detects that an EAS tag 112 is departing from the retail store without authorization, the system can respond by automatically activating the SRC beacon system 200 provided in the tag. For example, this can be accomplished by setting a session flag in the RFID element 210. The session flag can then be used as a beacon enable signal 213 to activate SRC beacon transmissions from the SRC beacon system 200. Alternatively, an SRC transceiver can be provided in the SRC beacon system instead of only an SRC transmitter 204, in which case the RFID portal can use an SRC transmitter 115 under control of the RFID server 109 to generate SRC signal to enable the SRC beacon. In some scenarios, the detection of an EAS tag departing the retail store facility without authorization can also trigger the capture of an image using an imaging device 113. The imaging device 113 is arranged and/or positioned to capture at least a face of a person who is transporting the EAS tag out of the retail store without authorization.

The RFID server 109 can further respond to the unauthorized departure of an EAS tag from the retail store by communicating with an RSF security server 120. This communication can be facilitated by a wired or wireless data network (not shown) which provides data communications between the RFID server 109 and the RSF security server 120. Such a communication can be used to alert the RSF security server 120 to the fact that the tag 112 has been removed from the retail store without authorization. According to one aspect, the communication to the RSF security server 120 can include the unique identifier 207*a*. The communication to the RSF security server can also include one or more images captured by the imaging device 113 at the time when the unauthorized departure of the EAS tag 112 from the retail store was detected.

Once activated, the SRC beacon system 200 begins periodically broadcasting certain beacon data pertaining to the EAS tag 112. A suitable broadcast interval for transmitting the beacon data will depend on many factors. Broadcasting more frequently uses more battery life but allows for quicker detection by SRC receiving devices. In an exemplary embodiment, the beacon data can be broadcast every 100 milliseconds.

The beacon data is broadcast using the SRC technology described herein so as to limit the effective range of such transmissions. For example, the effective transmission range of the beacon can be less than 100 meters. In some scenarios, the effective beacon range can be controlled so that is less than about 50 meters. In still other scenarios, the effective beacon range can be chosen so that it is less than about 10 meters. The effective beacon range can be controlled by limiting the effective radiated power of RF signals communicated using the SRC beacon system 200. The beacon data which is transmitted is strictly limited so as to minimize power required for beacon transmission.

Figure 3:
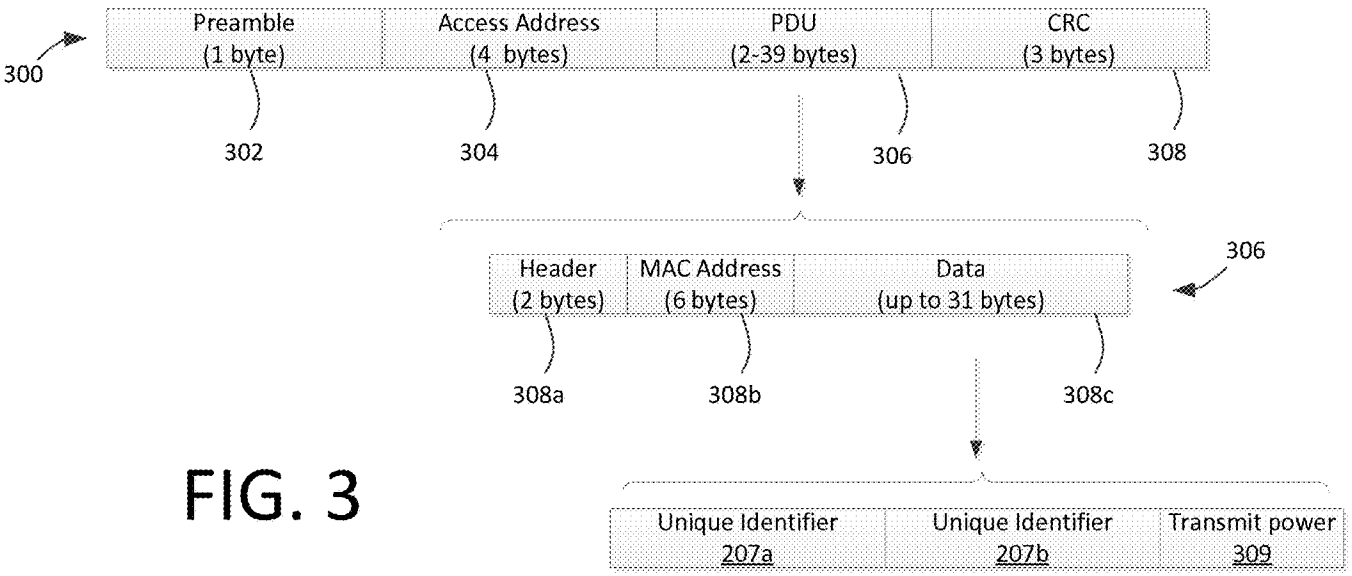
FIG. 3 is a diagram that is useful for understanding certain data structures that can be used in connection with the inventive arrangements.

An exemplary packet which can be transmitted by the beacon system 200 is shown in FIG. 3. The beacon packet 300 is a conventional BLE packet which is comprised of a preamble 302, an access address 304, a protocol data unit (PDU) 306, and a cyclic redundancy code (CRC) 308. The PDU is comprised of a header 308*a*, a media access control (MAC) address 308*b* and a data part 308*c*. According to one aspect, the unique identifier information pertaining the EAS tag can be included in the data part 308*c*. If the unique identifier 207*a* is the same as unique identifier 207*b*, then the data part need only contain the unique identifier 207*b*. If the unique identifier 207*a* is different from the unique identifier 207*b*, then the data part 308*c* can optionally include both unique identifiers. The data part can also specify a transmit power 309 of the beacon. This information can be useful for determining an approximate distance of the EAS tag 112 from the SRC devices $\mathbf{116}_1$, $\mathbf{116}_2$ . . . $\mathbf{116}_n$ which receives the packet.

Referring once again to FIG. 1, it can be observed that SRC devices $\mathbf{116}_1$, $\mathbf{116}_2$ . . . $\mathbf{116}_n$ are distributed at locations throughout the RSF 104. The SRC devices $\mathbf{116}_1$, $\mathbf{116}_2$ . . . $\mathbf{116}_n$ can also be positioned in the areas surrounding the RSF. For example one or more of the SRC devices can be disposed in an automobile parking area 106 which resides adjacent to or around the RSF 104. As such, the SRC devices $\mathbf{116}_1$, $\mathbf{116}_2$ . . . $\mathbf{116}_n$ can reside in the RSF facility or in the geographic areas surrounding the RSF facility. Alternatively or additionally, the SRC devices could be disposed in other sub-parts comprising a larger facility (not shown).

Each SRC device $\mathbf{116}_1$, $\mathbf{116}_2$ . . . $\mathbf{116}_n$ is operative to communicate information to and/or from other SRC devices via SRC technology (e.g., Bluetooth or BLE technology). To this end, the SRC devices $\mathbf{116}_1$, $\mathbf{116}_2$ . . . $\mathbf{116}_n$ can be wired together to form a network or can arranged to form a wireless ad hoc network to facilitate communications between and among the devices. The resulting network can also facilitate wired or wireless communications with a security server 120. Accordingly, each of the SRC devices can communicate with the security server 120 directly or indirectly using a suitable data network communication protocol. Each SRC device will have a specific network identity which allows communications from that SRC device to be differentiated from communications of all other SRC devices. For example, the network identity information can be defined by an internet protocol address, a media access control (MAC) address, and/or any other address information. The security server in turn has access to a relational database 121 which contains information that relates the identity information from each of the SRC devices to a particular location in the RSF 104 and/or parking area 106. In scenario where unique identifier 207*a* is different from unique identifier 207*b*, the relational database can also contain information which relates or associates a unique identifier 207*a* to the unique identifier 207*b*.

The unique identifier contained in the beacon data and the limited range of the beacon, provide a means to determine the location of the tag within the RSF 160 and/or parking area 106. The beacon transmissions are received by one or more of the SRC device $\mathbf{116}_1$, $\mathbf{116}_2$ . . . $\mathbf{116}_n$ as the EAS tag is transported throughout the RSF 160 and/or parking area 106. Upon receipt of such communication, an SRC device device $\mathbf{116}_1$, $\mathbf{116}_2$ . . . $\mathbf{116}_n$ will form a suitable data packet.

Figure 4:
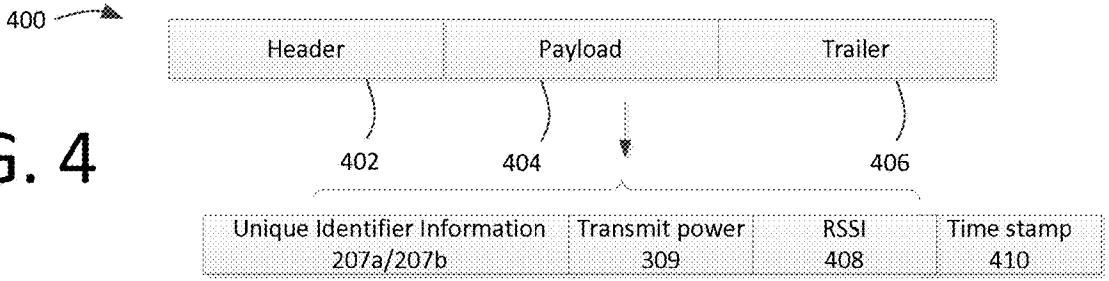
FIG. 4 is a diagram that is useful for understanding certain data structures that can be used in connection with the inventive arrangements.

FIG. 4 shows an exemplary data packet 400 which can be used for this purpose. The data packet will comprise a header 402, a payload 404 and a trailer 406. The header can include suitable information concerning an address for a destination node and the address of the node which originated the packet. The payload will include the tag's unique identifier information 207*a* and/or 207*b*. The payload data can also include the beacon's transmit power 309 and a time stamp 409 which specifies when the communication was received by the SRC device. The SRC device can detect a received power level to determine a received signal strength indication (RSSI) 408 with respect to the beacon transmission. In such scenarios, the RSSI information 308 can also be included as part of the payload data 404. The trailer 406 can be comprised of error checking bits, such as those which are used for cyclic redundancy checking. Once assembled, the data packet 400 is communicated to the RSF security server 120.

The receipt of the data packet 500 at the RSF security server 120 alerts the security sever that an SRC communication has been received at a particular SRC device, at a particular time, from a particular tag 112 having the specified unique identifier. In response to receiving this information from the SRC device $\mathbf{116}_1$, $\mathbf{116}_2$ . . . $\mathbf{116}_n$, the RSF security server 120 will access its relational database 121 to determine whether it has been notified that the identified EAS tag is one that has been removed without authorization from a secured retail store location. If so, then the RSF security server will access the relational database to determine a location of the SRC device $\mathbf{116}_1$, $\mathbf{116}_2$ . . . $\mathbf{116}_n$ which received the SRC communication. The security server can then present this information to a user in a suitable manner to facilitate tracking of the tag 112.

For example, when a particular SRC device receives an SRC communication from tag 112, tag tracking information can be graphically presented in a display which superimposes the location of each SRC devices $\mathbf{116}_1$, $\mathbf{116}_2$ . . . $\mathbf{116}_n$, with a floorplan, map or layout of the RSF 104 and/or shopping area 106. The particular SRC device which is the most recent to have received a beacon communication from an EAS tag 112 can be indicated using a suitable graphical element 122. Identification of the most recent SRC device to receive an SRC communication can be determined based on the time stamp information 410 provided by the SRC device $\mathbf{116}_1$, $\mathbf{116}_2$ . . . $\mathbf{116}_n$.

The graphical element used to identify the SRC device which received the communication can comprise a marking, illumination or highlighting of a graphical symbol or location to identify the particular SRC which received an SRC communication from the tag 112. This information can then be used to direct security personnel to an area of the RSF 104 and/or parking area 106 where the tag 112 is present. Alternatively, a plurality of such graphical elements can be used to indicate a direction of movement of the tag 112. For example, such graphical elements can include a track 128 which specifies a direction of movement of a tag 112.

In its most simple form, the tag tracking described herein can be based exclusively on time stamp information concerning the particular SRC device which is the most recent to have received an SRC communication from tag 112. This approach can work well when beacon transmit power is minimal and the SRC devices are widely dispersed so that an SRC communication from a beacon can be expected to be received at only one SRC device at a time. However, the invention is not limited in this regard and more sophisticated means can also be employed to utilize SRC communications for tracking.

Figure 5:
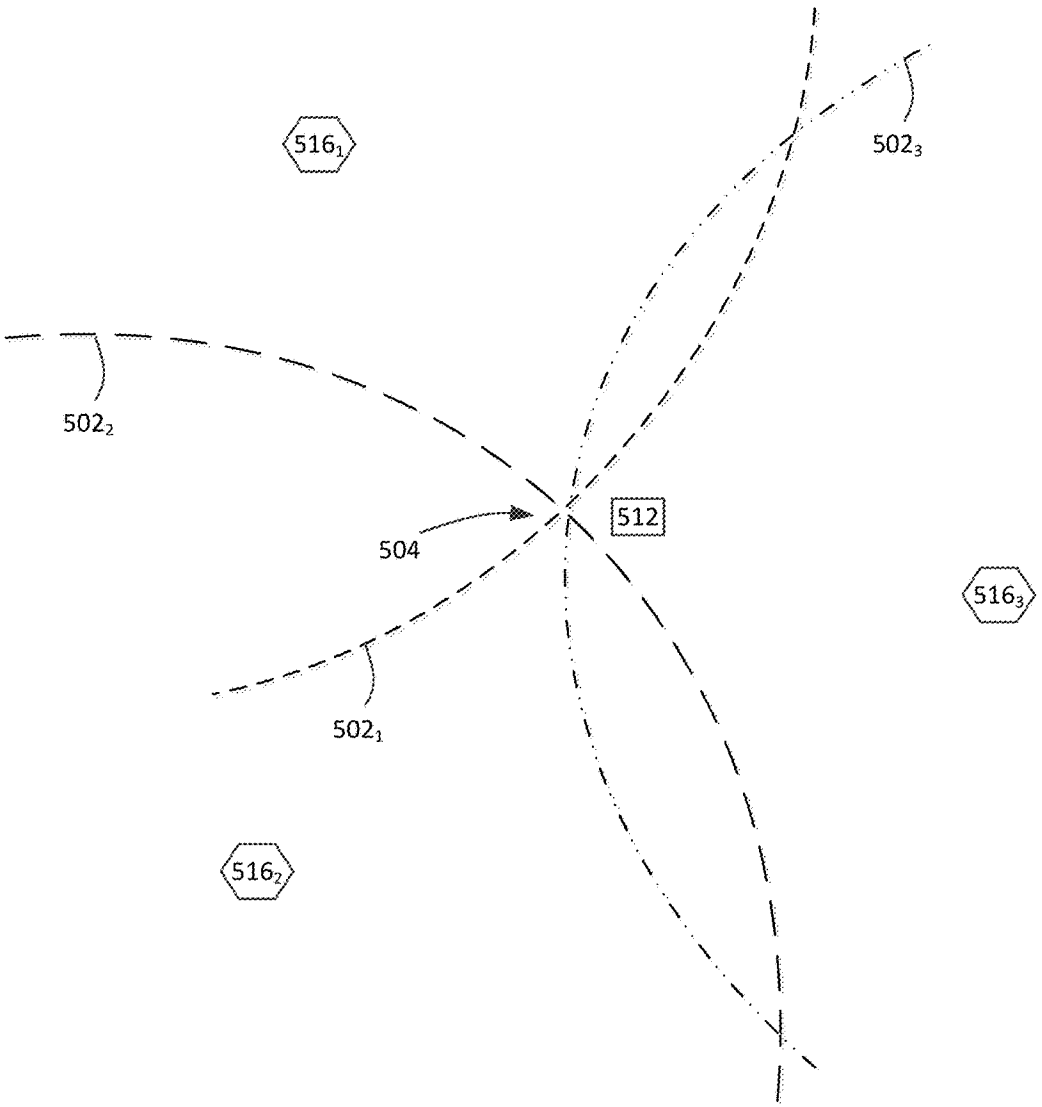
FIG. 5 is a diagram that is useful for understanding how a beacon transmission received at multiple devices can be used to determine a location of an EAS tag.

For example, consider the scenario shown in FIG. 5 in which a EAS tag 512 containing an SRC beacon system as described herein is located some distance from each of three SRC devices $\mathbf{516}_1$, $\mathbf{516}_2$, $\mathbf{516}_3$ such that a particular SRC communication is received at about the same time by each of the SRC devices. In such a scenario, an RSF security server 120 could use time stamp information 410 extracted from each received data packet 400 to correlate an SRC communication received at about the same time by multiple SRC devices $\mathbf{516}_1$, $\mathbf{516}_2$, $\mathbf{516}_3$. Such correlation will indicate that the data packets from each of the SRC devices were triggered by the same SRC beacon transmission. The RSF security server could then utilize the RSSI and the transmit power 309 information included in a data packet received from each SRC device $\mathbf{516}_1$, $\mathbf{516}_2$, $\mathbf{516}_3$ to estimate a distance of the EAS tag 512 from each of the SRC devices at the time that the SRC communication was received. This distance is shown in FIG. 5 as dotted arcuate lines $\mathbf{502}_1$, $\mathbf{502}_2$, $\mathbf{502}_3$ which represent the estimated distance of the tag 512 from each SRC device. In such a scenario, an intersect location 504 where the three arcuate lines intersect will define an approximate location of the tag 512. Accordingly, an RSF security server can estimate a location of the tag 512 based on SRC communications from multiple SRC devices.

Referring once again to FIG. 1, the information which is determined by RSF security server 120 concerning the location of the EAS tag 112 can be presented to a dispatcher on a display device (not shown) in a security facility 124. One or more images captured by the imaging device 113 can also be presented to a dispatcher. The dispatcher can then use the information to dispatch security personnel to the current location where the EAS tag 112 can be found, together with a description of the person who was caused the unauthorized removal of the tag from the store. However, the invention is not limited in this regard and the information concerning the location of the EAS tag can instead be broadcast to a handheld mobile communication device (MCD) 126*a*, 126*b*, 126*c* such as a tablet, smartphone, and/or land-mobile radio (LMR). The tracking information can then be displayed directly to security personnel dispersed throughout the RSF 104 and/or parking area 106. Likewise, one or more images of the person responsible for the unauthorized removal of the EAS tag from the retail store premises can also be displayed on the MCD.

As an alternative or in addition to the foregoing methods of tracking, the SRC devices $116_1$, $116_2$ . . . $116_n$ can include an alerting mechanism to directly alert security personnel that the EAS tag 112 is in a particular area. The alerting mechanism can be an audible or visual indication provided at each SRC device which indicates that the SRC device has received an SRC communication from the tag 112 within some recent predefined period of time. A suitable audio annunciator and/or LED signal lamp could be used for this purpose.

In some scenarios, the alerting mechanism can be automatically disabled by the SRC device after some predetermined period of time. However, in an alternative embodiment an alerting mechanism provided at an SRC device can be disabled when RSSI information indicates that the EAS tag 112 is closer to a different SRC device. In such a scenario, an SRC device will terminate its alerting mechanism when other SRC devices are detecting the beacon signal with greater signal strength (indicating closer proximity of a tag to a different SRC device). The SRC devices can obtain RSSI information for this purpose by monitoring data packets communicated from other SRC devices to the RSF security server 120. Alternatively, the security server 120 can monitor such information and communicate to the SRC devices when the alerting mechanism should be disabled.

Figure 6:
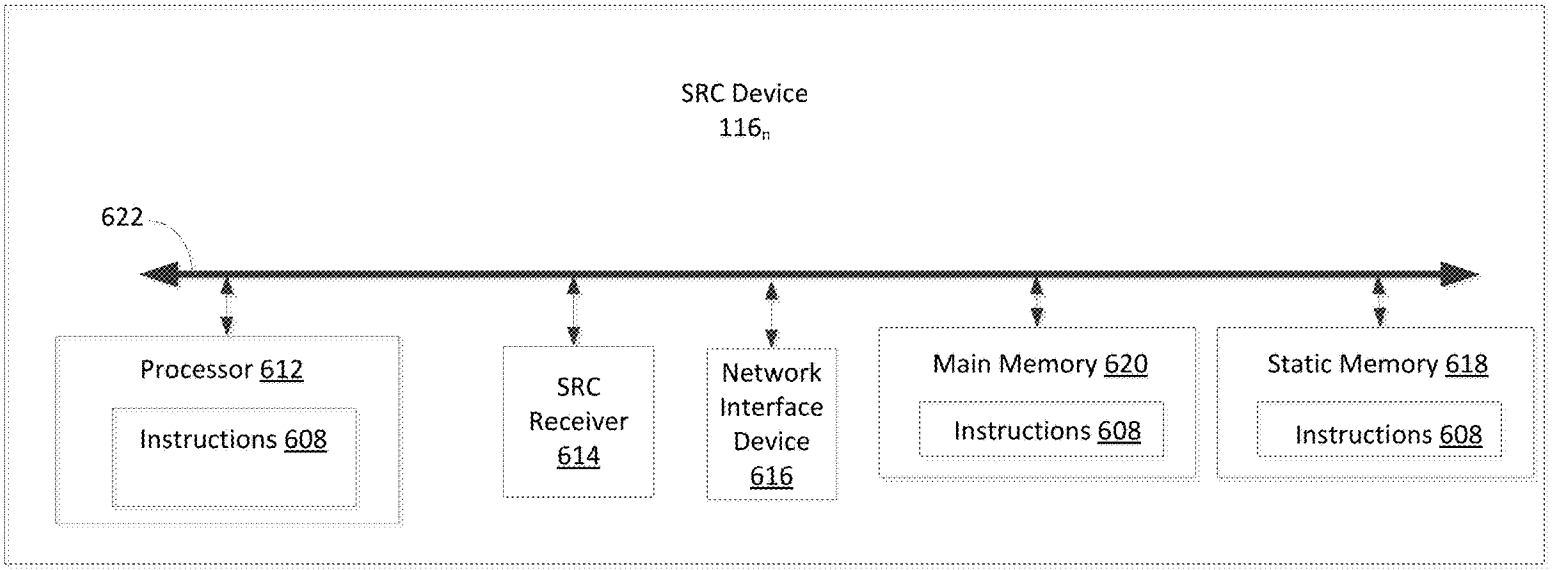
FIG. 6 is an exemplary architecture of an SRC device that can be used to facilitate EAS tag tracking.

Referring now to FIG. 6, a block diagram is provided of an exemplary SRC device $116_n$. The device includes a processor 612 (such as a central processing unit (CPU)), a main memory 620 and a static memory 618, which communicate with each other via a bus 622. The SRC device $116_n$ can further include an SRC receiver 614 and a network interface device 616. The SRC receiver 614 is capable of receiving and demodulating beacon transmissions from the SRC beacon system 200. These packet data comprising these transmissions can be decoded and acted upon by the processor 612 as described herein. The network interface device 616 can be wired or wireless network device that is capable of facilitating network data communications with the RSF security server 120. Accordingly, the network device can be compliant with any data network standard now known or known in the future.

The main memory 620 can include a computer-readable storage medium on which is stored one or more sets of instructions 608 (e.g., software code) configured to implement one or more of the methodologies, procedures, or functions described herein. The instructions 608 can also reside, completely or at least partially, within the static memory 618, and/or within the processor 612 during execution thereof. The static memory 618 and the processor 612 also can constitute machine-readable media.

The SRC device architecture illustrated in FIG. 6 is one possible example of a SRC device which can be used for implementing the inventive arrangements described herein. However, the invention is not limited in this regard and any other suitable SRC device architectures can also be used without limitation. Dedicated hardware implementations including, but not limited to, application-specific integrated circuits, programmable logic arrays, and other hardware devices can likewise be constructed to implement the methods described herein. Applications that can include the apparatus and systems of various embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Figure 7:
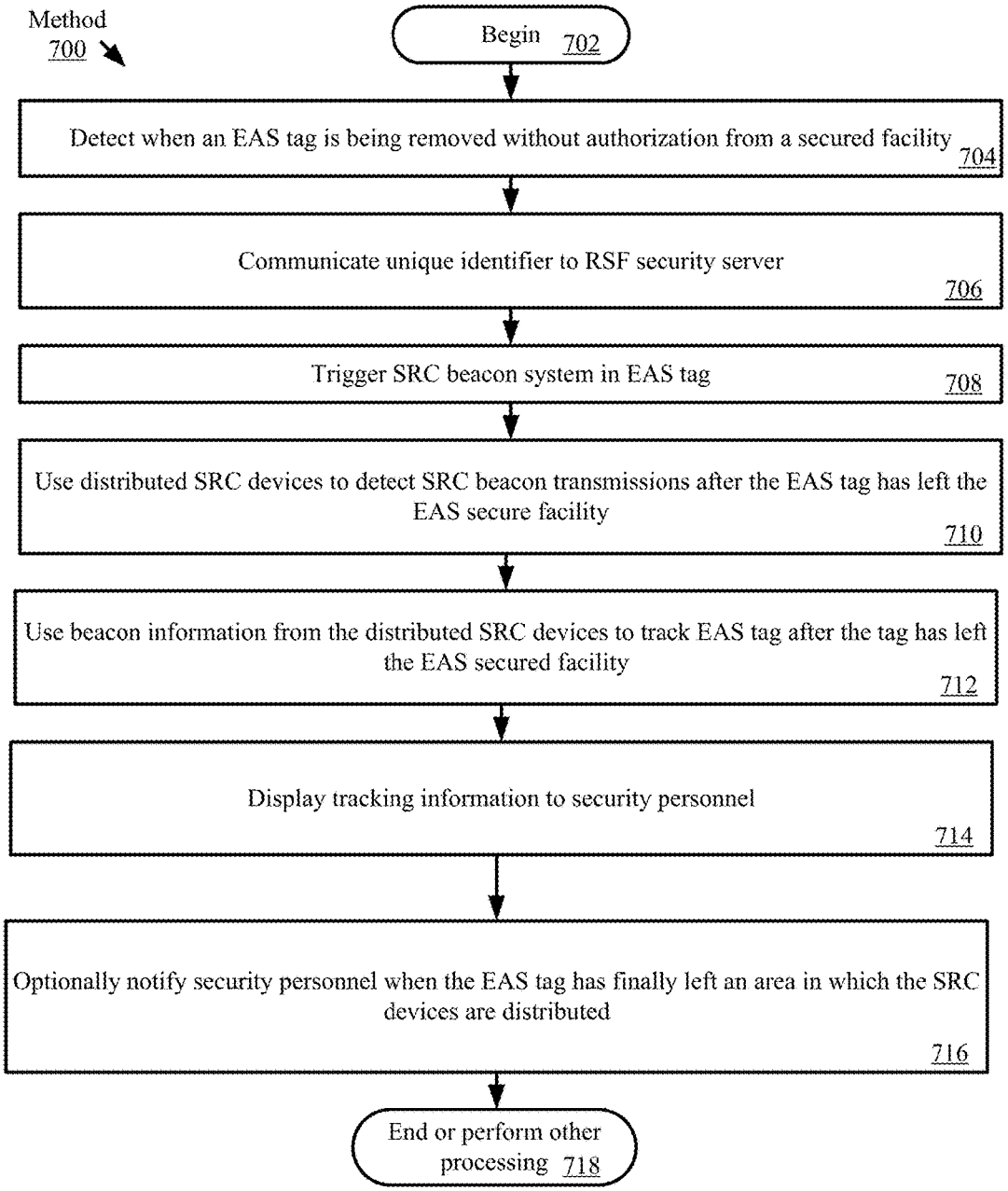
FIG. 7 is a flowchart that is useful for understanding a method for tracking EAS tags outside of a security facility protected by an EAS system.

Referring now to FIG. 7, a flowchart is provided to facilitate an understanding of a method for tracking EAS tags when they have been transported away from a secured facility without authorization. The process begins in step 702 and continues to step 704 in which an EAS system detects that an EAS tag 112 has been removed without authorization from an EAS system secured facility, such as a retail store 102*b*. In connection with such detection, the EAS system determines a unique identifier of the EAS tag. The EAS system can also optionally use imaging device 113 to acquire an image of the person who has removed the tag from the secured facility without authorization. In step 706, the unique identifier information is communicated from the EAS system to the RSF security server 120. This step can also involve communication to the RSF server of the image of the person captured by the imaging device 113. The EAS system in step 708 will also trigger the operation of the SRC beacon system in the EAS tag 112.

In step 710, the distributed SRC devices $116_1$, $116_2$ . . . $116_n$ are used to detect the SRC beacon transmissions after the EAS tag has left the confines of the secured facility. The SRC beacon transmissions are used to track the movement of the EAS tag outside the confines of the secured facility. In step 712, the information from the distributed SRC devices is used to provide EAS tag tracking. This information is provided or displayed to security personnel in step 714. In step 716, security personnel can be notified when the EAS tag has finally left an area in which the SRC devices are distributed. For example, with reference to FIG. 1, if an EAS security tag beacon transmission is detected by an SRC device $116_n$ at a parking area departure gate 118, then it can reasonably be assumed that there is no further benefit to searching for the person responsible for removing the tag from the secured facility. At 718 the process can be terminate or can continue with other processing.

In accordance with various embodiments of the present invention, the methods described herein are stored as software programs in a computer-readable storage medium and are configured for running on a computer processor. The term "computer-readable storage medium" shall be taken to include any medium that is capable of storing or encoding a set of instructions for execution by the machine and that cause the machine to perform any one or more of the methodologies of the present disclosure. Accordingly, a "computer-readable medium" shall be taken to include, but not be limited to, solid-state memories such as a memory card or other package that houses one or more read-only (non-volatile) memories, random access memories, or other re-writable (volatile) memories; magneto-optical or optical mediums such as a disk or tape. The disclosure is considered to include any one or more of a computer-readable medium as listed herein and to include recognized equivalents and successor media, in which the software implementations herein are stored.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

I claim:

1. An electronic article surveillance (EAS) system, comprising: an EAS portal; and an EAS tag comprising a tag housing, an RFID element disposed in the tag housing, and which is responsive to an RFID interrogation field applied at the EAS portal to generate an encoded RF signal which contains a first unique identifier information identifying the EAS tag, and a short range communication (SRC) beacon system exclusive of the RFID element and also disposed in the tag housing, the SRC beacon system configured to continuously generate an SRC radio beacon transmission at predetermined intervals in response to a beacon enable signal received from the EAS portal or the RFID element, and a mechanical coupler provided for coupling the EAS tag to an item to be protected; wherein the EAS system is configured to generate the RFID interrogation field, automatically detect a departure of the EAS tag from a secured facility when the EAS tag passes through the EAS portal, determine whether the EAS tag's departure is authorized or unauthorized, responsive to a determination that the EAS tag's departure is unauthorized, automatically generate at least one wireless transmission which is configured to cause the SRC beacon system to receive the beacon enable signal, whereby the EAS system selectively causes the SRC beacon system to continuously generate the SRC radio beacon transmission at predetermined intervals only after the EAS tag has departed the secured facility, and track the EAS tag's location outside the secured facility using the SRC radio beacon transmission being emitted from the EAS tag.

2. The EAS system according to claim 1, wherein the RFID element is a passive RFID element.

3. The EAS system according to claim 2, wherein the SRC beacon system is compliant with a Bluetooth Low Energy standard.

4. The EAS system according to claim 1, wherein the RFID element is responsive to the at least one wireless transmission to generate the beacon enable signal.

5. The EAS system according to claim 1, wherein the SRC beacon system includes an SRC receiver which is responsive to the at least one wireless transmission to initiate the beacon enable signal.

6. The EAS system according to claim 1, wherein a boundary defined by the EAS portal is between a secured area associated with the secured facility and a non-secured area exclusive of the secured facility, such that the EAS system is arranged to detect EAS tags leaving the secured area.

7. The EAS system according to claim 6, further comprising a plurality of SRC devices which are distributed in the non-secured area, each configured to receive one or more of the SRC radio beacon transmissions when the EAS tag is in a predetermined beacon proximity relative to one or more of the SRC devices.

8. The EAS system according to claim 7, further comprising at least one security server communicatively coupled to the plurality SRC devices for data communications.

9. The EAS system according to claim 8, wherein the at least one security server has access to location information concerning a location of each of the plurality of SRC devices.

10. The EAS system according to claim 9, wherein the at least one security server is communicatively coupled to a computer display device to facilitate tracking of the EAS tag in the unsecured area based on the location of one or more of the SRC devices which receive the SRC radio beacon transmissions.

11. An electronic article surveillance (EAS) tag, comprising:

a tag housing;

a passive RFID element disposed in the tag housing, and which is responsive to an RFID interrogation field applied at the EAS portal to generate an encoded RF signal which contains a first unique identifier information identifying the EAS tag; and a short range communication (SRC) beacon system exclusive of the RFID element and also disposed in the tag housing, the SRC beacon system configured to, when activated, continuously generate at predetermined intervals a radio beacon transmission compliant with a Bluetooth data communication standard;

wherein said EAS tag is configured to selectively automatically trigger the activation of the SRC beacon system when passing through an EAS portal which demarcates a transition from an EAS secured area to an unsecured area by interacting with the EAS portal to initiate a determination as to whether the EAS tag is authorized to pass through the EAS portal, receiving at the EAS tag at least one wireless transmission initiated as a result of the interaction when the determination reveals that the EAS tag is not authorized to pass through the EAS portal, applying a beacon enable signal to the SRC beacon system responsive to the at least one wireless transmission;

wherein the radio beacon transmission includes a second unique identifier identifying said EAS tag, the SRC beacon system is activated when the EAS tag's departure from a secured facility is determined by an EAS system to be unauthorized, and the radio beacon transmission is used by the EAS system to track the EAS tag's location outside the secured facility.

12. The EAS tag according to claim 11, wherein the first and second unique identifiers are the same.

13. The EAS tag according to claim 11, wherein the RFID element is responsive to the at least one wireless transmission to generate the beacon enable signal.

14. The EAS tag according to claim 11, wherein the SRC beacon system includes an SRC receiver which is responsive to the at least one wireless transmission that is compliant with a Bluetooth data communication standard to initiate the beacon enable signal.

15. A tracking system for a facility, comprising: at least one security server communicatively coupled to at least one data network; a plurality of short range communication (SRC) devices disposed in unsecured areas of a facility which are not protected by an EAS system, the SRC devices distributed at various locations associated with the facility and operating in accordance with a short range wireless communication standard (SRWCS), each SRC device including a receiver provided for receiving a wireless beacon signal transmitted from at least one EAS tag of a plurality of SRC enabled EAS tags when in proximity thereof, the wireless beacon signals compliant with the SRWCS, and each SRC device including at least one data network device to facilitate communication with other devices, including the at least one security server, using the at least one data network; a data store accessible to the at least one security server containing information specifying a location information for each of the plurality of SRC devices, the security server arranged to receive EAS notifications over said at least one data network from each of a plurality of EAS servers which are used respectively to control security functions of a plurality of defined security areas within the facility, the security areas exclusive of the unsecured areas; wherein each of the SRC devices is responsive to receipt of the wireless beacon signal from the SRC enabled EAS tags to cause a notification to be sent to the security server, and the security server is responsive to the notification to determine an approximate location of the EAS tag within the unsecured areas at said facility based on said notification and by using the location information; wherein the tracking system is further comprised of at least one EAS system configured to automatically detect a departure of at least one SRC enabled EAS tag from at least one of the security areas when the EAS tag passes through an EAS portal demarcating a transition from the at least one security area to the unsecured areas; determine whether the SRC enabled EAS tag's departure is authorized or unauthorized; responsive to a determination that the EAS tag's departure is unauthorized, automatically generate at least one wireless transmission which causes an SRC beacon system associated with the at least one EAS tag to continuously generate the wireless beacon signal at predetermined intervals only after the EAS tag has departed the security area; and track the SRC enabled EAS tag's location outside the secured facility using the wireless beacon signal being emitted from the SRC enabled EAS tag.

16. The tracking system according to claim 15, wherein the EAS notification comprises an indication that one of the SRC enabled EAS tags has exited one of the security areas, and include at least one unique identifier of the SRC enabled EAS tag.

17. The tracking system according to claim 15, wherein the EAS tag is comprised of an RFID element which is responsive to an RFID interrogation signal produced at the EAS portal to generate a wireless RFID response signal specifying a unique identifier of the SRC enabled EAS tag.

18. The tracking system according to claim 15, wherein the SRC enabled EAS tag comprises control logic which causes the wireless beacon signal to be continuously repeated at predetermined intervals after the EAS tag has exited the security area.

19. The tracking system according to claim 18, wherein the EAS tag is further comprised of an RFID element which is operatively connected to the control logic to initiate the continuously repeated wireless beacon signal.

20. The tracking system according to claim 15, wherein the SRWCS is a Bluetooth standard.

21. The tracking system according to claim 15, wherein the security server determines an approximate location of the EAS tag at said facility based on a plurality of said notification and by using the location information for a plurality of SRC devices.

22. A method for tracking items in a facility, comprising:

using an RFID portal system to determine when an EAS tag containing an RFID element has exited from the facility and to determine if the EAS tag's exiting was made with authorization or without authorization;

in response to a determination that the EAS tag exited from the facility without authorization, performing operations by the RFID portal system to cause a beacon enable signal to be provided to a short range communication ("SRC") beacon system of the EAS tag for initiating a wireless beacon signal compliant with a short range wireless communication standard;

using control logic associated with the EAS tag to cause the wireless beacon signal to be communicated at predetermined intervals after being initiated and including in the wireless beacon signal unique identifier information concerning the EAS tag; and tracking the EAS tag's location outside the facility using the wireless beacon signal being emitted from the EAS tag.

23. The method according to claim 22, further comprising:

receiving the wireless beacon signal at one or more of a plurality of short range communication (SRC) devices which are distributed at locations around the facility external of the secured area;

responsive to receiving the wireless beacon signal, using a data network to communicate at least one notification from at least one of the SRC devices to a security server to indicate receipt of the wireless beacon signal;

identifying at the security server a location of the EAS tag at the facility, external of the secured area, based on at least one location of one or more of the SRC devices which originated the at least one notification.

24. The method according to claim 23, further comprising graphically displaying an approximate location of the EAS tag external of the secured area at a location associated with the facility based on the identifying step.

25. The method according to claim 23, further comprising determining when the EAS tag has exited from the facility premises.

* * * * *